US007967463B2

(12) United States Patent
Chen

(10) Patent No.: US 7,967,463 B2
(45) Date of Patent: Jun. 28, 2011

(54) PEN HAVING A DECORATION

(76) Inventor: Chung-Ping Chen, Shu-Lin (TW)

( * ) Notice: Subject to any disclaimer, the term of this patent is extended or adjusted under 35 U.S.C. 154(b) by 289 days.

(21) Appl. No.: 12/427,238

(22) Filed: Apr. 21, 2009

(65) Prior Publication Data

US 2010/0265698 A1 Oct. 21, 2010

(51) Int. Cl.
*B43K 29/10* (2006.01)
*B43K 29/00* (2006.01)

(52) U.S. Cl. ..... 362/118; 401/195

(58) Field of Classification Search ..... 362/118; 401/195

See application file for complete search history.

(56) References Cited

U.S. PATENT DOCUMENTS

| | | | | |
|---|---|---|---|---|
| 5,405,208 | A * | 4/1995 | Hsieh | 401/195 |
| 6,158,871 | A * | 12/2000 | Geddes et al. | 362/118 |
| 6,428,179 | B1 * | 8/2002 | Saffron et al. | 362/118 |
| 6,585,388 | B2 * | 7/2003 | Kim | 362/118 |
| 2009/0196021 | A1 * | 8/2009 | Liu | 362/118 |

* cited by examiner

*Primary Examiner* — Jong-Suk (James) Lee
*Assistant Examiner* — David J Makiya
(74) *Attorney, Agent, or Firm* — Pro-Techtor Int'l Services; Ralph Willgohs

(57) ABSTRACT

A pen having a decoration includes a decoration on a pen-holder. The decoration contains an illuminator. When the decoration rotates, the illuminator emits light. On the other hand, upon writing with the pen, the illuminator emits the light as well. Therefore, the illuminator will emit the light by this dual switch.

1 Claim, 5 Drawing Sheets

PEN HAVING A DECORATION

BACKGROUND OF THE INVENTION a) Field of the Invention

The present invention relates to a pen having a decoration, and more particularly to a pen having a decoration wherein the decoration can emit light when a nib is touched or the decoration rotates.

b) Description of the Prior Art

An ordinary pen is only capable of writing. Therefore, some vendor has developed a light pen, where a nib can emit light when the nib is touched; whereas, other vendor has provided a non-illuminating decoration on a pen. However, all the aforementioned pens only have a single function and are not able to provide a dual effects that the decoration will illuminate when the decoration spins or the nib is touched.

SUMMARY OF THE INVENTION

The primary object of the present invention is to provide a pen having a decoration. A penholder of the pen is provided with a decoration, when the decoration rotates, the decoration can be controlled to illuminate or not to illuminate, and when a nib is touched, the decoration can illuminate as well.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
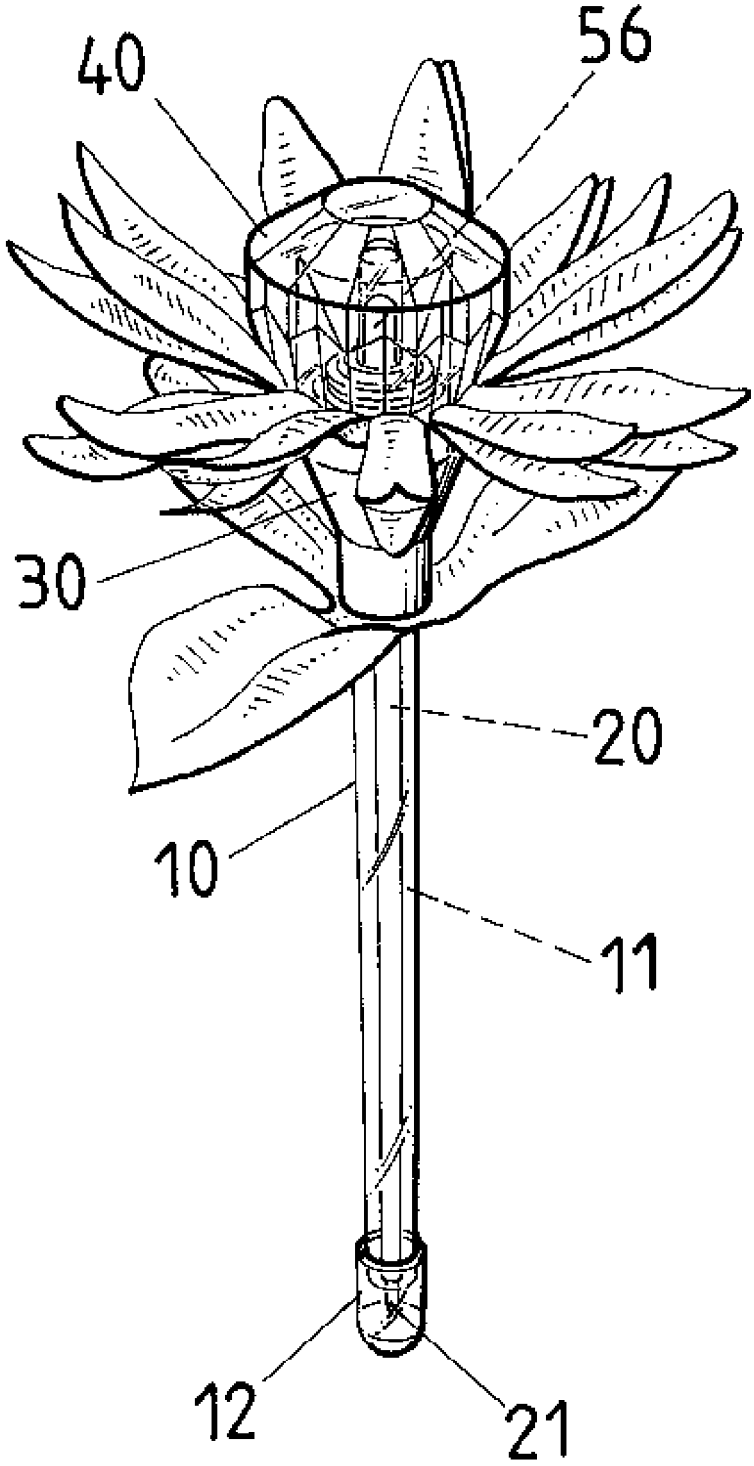
FIG. 1 shows an external view according to the present invention.
Figure 2:
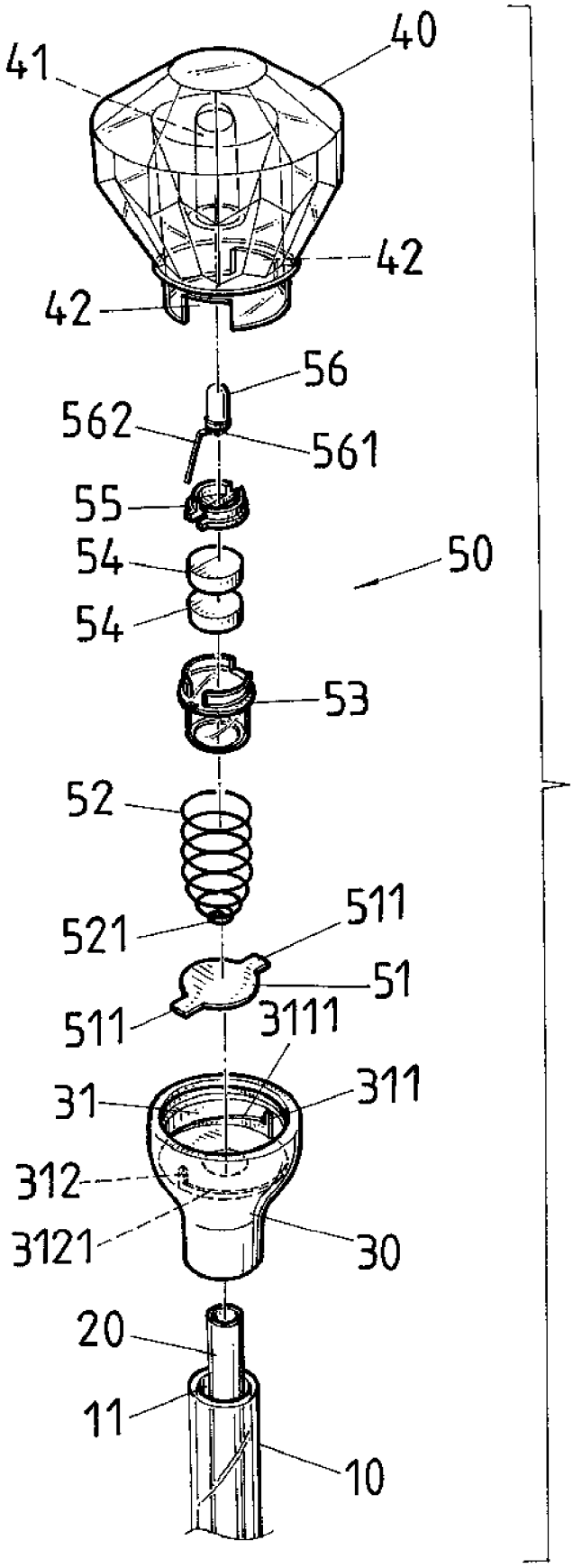
FIG. 2 shows an exploded view according to the present invention.
Figure 3:
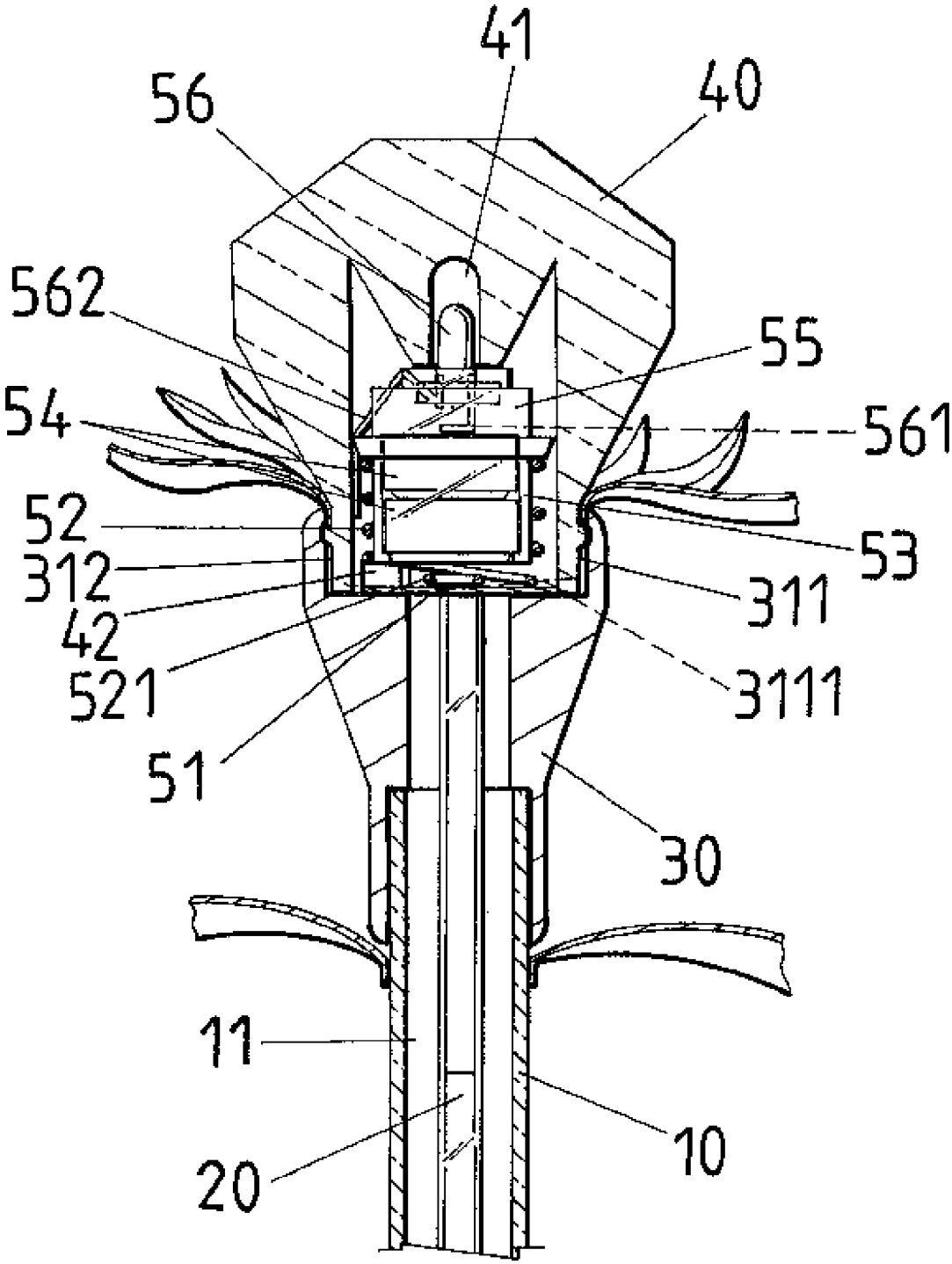
FIG. 3 shows a cross-sectional view according to the present invention.

Referring to FIGS. 1 to 3, the present invention comprises a penholder 10, a refill 20, a socket 30, a decoration 40 and an illuminator 50, wherein the refill 20 is inserted into a through-hole 11 of the penholder 10, a nib 21 at an end of the refill 20 is protruded out of the penholder 10, an end of the penholder 10 is sheathed with a pen cap 12, the other end of the penholder 10 is sheathed with the socket 30, the refill 20 transfixes through the socket 30, the decoration 40 is latched on the socket 30 and the illuminator 50 is emplaced in the decoration 40.

The illuminator 50 includes a lift plate 51, a spring 52, a battery holder 53, two batteries 54, a lamp holder 55 and an LED 56. The lift plate 51 is provided in the socket 30, above the lift plate 51 is provided with the spring 52 on which is sheathed with the battery holder 53, and an interior of the battery holder 53 is emplaced with the two batteries 54. The lamp holder 55, which is connected with the LED 56, is latched on a top end of the battery holder 53, wherein a bottom pin 561 of the LED 56 constantly contacts with the batteries 54, a side pin 562 constantly contacts with the spring 52, and the LED 56 is extended into an LED chamber 41 of the decoration 40.

Figure 4:
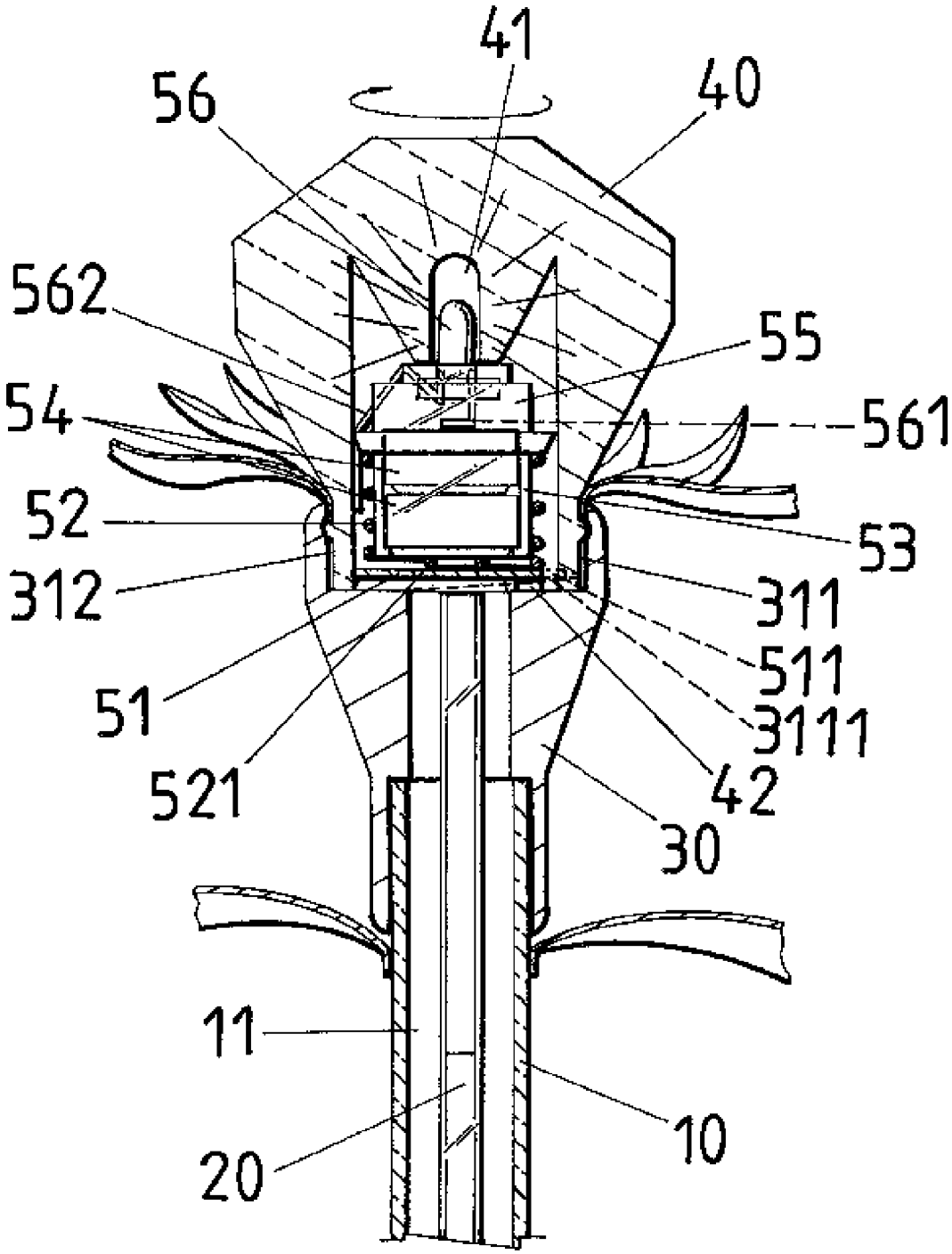
FIG. 4 shows a schematic view of an embodiment according to the present invention.

Referring to FIG. 4, an inner rim of the socket 30 is provided with a holding chamber 31, corner edges in the holding chamber 31 are provided respectively with a stop strip 311, 312, side edges of the stop strips 311, 312 are provided respectively with a slope-shape ring 3111, 3121, two wings 511 of the lift plate 51 are emplaced in the holding chamber 31, and two lock slots 42 at a bottom end of the decoration 40 are locked at the two wings 511 of the lift plate 51. Referring to FIG. 4, when the decoration rotates 40, the two wings 511 of the lift plate 51 will be driven to move upward along the slope-shape rings 3111, 3121 in the socket 30, until touching the two stop strips 311, 312. Whereas, ascending of the lift plate 51 also allows a contact 521 which is extended by compressing a bottom end of the spring 52 to touch the batteries 54, thereby making the LED 56 to illuminate by conducting a circuit. On the contrary, when the decoration 40 rotates counterclockwise, the two wings 511 of the lift plate 51 will be driven to move down along the slope-shape rings 3111, 3121, allowing the contact 521 of the spring 52 not to touch the batteries 54, thereby extinguishing the LED 56 by shutting down the circuit.

Figure 5:
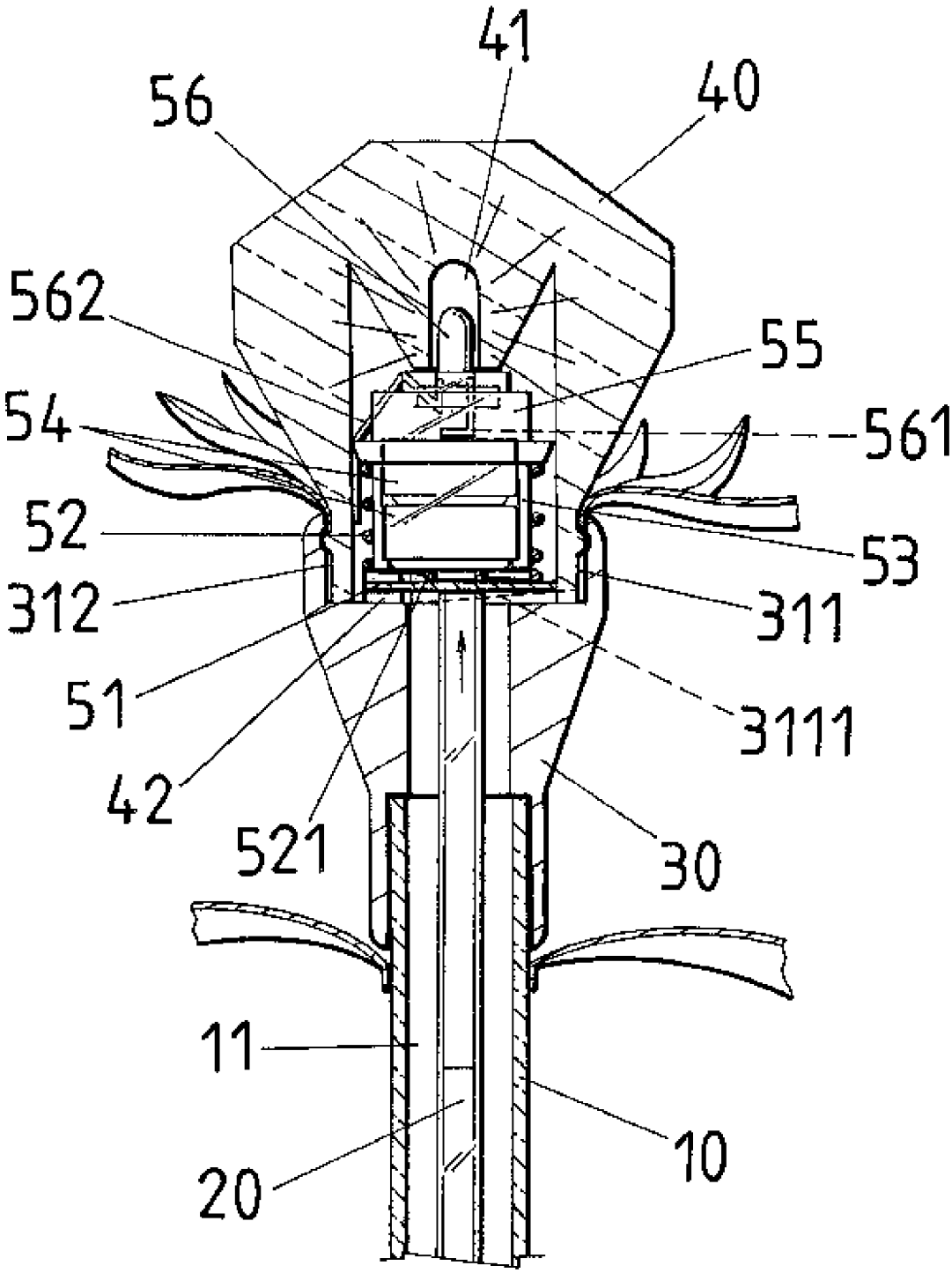
FIG. 5 shows a schematic view of another embodiment according to the present invention.

Referring to FIG. 5, when writing, the nib 21 drives the refill 20 to move upward, allowing the refill 20 to push directly the lift plate 51 to compress the bottom end of the spring 52 that the contact 521 will touch the batteries 54, thereby making the LED 56 to illuminate by conducting a circuit. When the writing stops, as the nib 21 does not drive the refill 20 to move upward, the refill 20 will not push upward the lift plate 51 to compress the bottom end of the spring 52 that the contact 521 will not touch the batteries 54, thereby extinguishing the LED 56 by shutting down the circuit.

Conclusive from the above, in accordance with the present invention, the pen is provided with the decoration, wherein when the decoration rotates, the illuminator will emit light, and when the pen is being used for writing, the illuminator will emit the light as well.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A pen having a decoration comprising a penholder, an interior of which is provided with a through-hole; a refill, which is inserted into the through-hole of the penholder and an end of which is provided with a nib; a socket, an inner rim of which is provided with a holding chamber, with corner edges in the holding chamber being provided respectively with a stop strip, and side edges of the two stop strips being provided respectively with a slope-shape ring; a decoration, which is latched on the socket, and a lower end of which is provided with two lock slots; and an illuminator, which is emplaced in the decoration and includes a lift plate, which is emplaced in the socket and two wings of which are emplaced in the holding chamber of the socket and provide for locking the two lock slots of the decoration, a spring, a bottom of which is extended with a contact and which is provided on the lift plate; a battery holder, which is sheathed on the spring and an interior of which is emplaced with two batteries; and a lamp holder, an interior of which is connected with an LED, with a bottom pin of the LED touching the batteries and a side pin of the LED touching the spring; when the decoration rotates, two wings of the lift plate being driven to move upward along the slope-shape rings in the socket to compress a bottom end of the spring that the contact touches the batteries, allowing the LED to illuminate; when writing with the pen, the nib driving the refill to move upward to push the lift plate to compress the bottom end of the spring that the contact touches the batteries, allowing the LED to illuminate.

* * * * *